US005283706A

United States Patent [19]

Lillemo et al.

[11] Patent Number: 5,283,706

[45] Date of Patent: Feb. 1, 1994

[54] SWITCHING CIRCUIT

[76] Inventors: Sverre Lillemo, N-7060 Klaebu; Kjell I. Iversen, Nordslettv. 325, N-7038 Trondheim, both of Norway

[21] Appl. No.: 671,519

[22] Filed: Mar. 19, 1991

Related U.S. Application Data

[63] Continuation of PCT/NO89/00095, Sep. 18, 1989.

[30] Foreign Application Priority Data

Sep. 19, 1988 [NO] Norway ..... 884150

[51] Int. Cl.[5] ..... H01H 9/30

[52] U.S. Cl. ..... 361/3; 361/13

[58] Field of Search ..... 307/117; 361/3, 8, 13, 361/2, 5, 6, 7

[56] References Cited

U.S. PATENT DOCUMENTS

| | | | |
|---|---|---|---|
| 3,812,382 | 8/1972 | Pascente | 307/133 |
| 4,074,333 | 2/1978 | Murakami et al. | 361/13 |
| 4,525,762 | 6/1985 | Norris | 361/13 |
| 4,751,401 | 3/1987 | Beigel et al. | 307/140 |
| 4,772,809 | 9/1988 | Koga et al. | 361/13 |
| 5,053,907 | 10/1991 | Nishi et al. | 361/13 |

FOREIGN PATENT DOCUMENTS

| | | |
|---|---|---|
| 0146809 | 7/1985 | European Pat. Off. . |
| 192258 | 8/1986 | European Pat. Off. . |
| 275960 | 1/1988 | European Pat. Off. . |
| 2421558 | 11/1975 | Fed. Rep. of Germany . |
| 2613929 | 5/1979 | Fed. Rep. of Germany . |
| 2195831 | 4/1988 | United Kingdom . |

*Primary Examiner*—Todd E. De Boer
*Attorney, Agent, or Firm*—James E. Pittenger

[57] ABSTRACT

An electrical switching circuit comprising an electromagnetic relay and a bye directively controlled contactless switch. The electrical switching circuit being able to make and break a capacitive, inductive or pure resistive electrical loads without forming arcs and without substantial heat loss. A control voltage as applied through a phase detecting opticoel coupler to a bye directively controlled contactless switch, such as a triac. The same control voltage is also connected to a time delay circuit wherein the time delay circuit after being charged energizes an electromagnetic relay connecting the load circuit. Upon disconnecting the load the sequence of operation is reversed. The electromagnetic relay is deenergized while the time delay circuit retains the opticoel coupler connection which in turn retains the energization of the contactless switch until the phase of the load energy source to be precisely at the zero voltage crossing at which time the contactless switch is also deenergized. The delay built into the time delay circuit is at least one half of the period of the load energy source so that the disconnection will be made at the zero voltage crossover point to prevent any arc from occurring.

3 Claims, 1 Drawing Sheet

SWITCHING CIRCUIT

This is a continuation of International application PCT/NO89/00095, filed Sep. 18, 1989, which designated the United States, and was co-pending with this application and is now abandoned.

FIELD OF THE INVENTION

The invention relates generally to a switching circuit for making and breaking capacitive, inductive and resistive load in an electrical circuit.

BACKGROUND OF THE INVENTION

Electrical switching devices are known in various embodiments, commonly known by the term "relay". Electromagnetic relays have been available for years, but they demand a lot of space, energy, and they generate electrical noise when the contacts make and break. Such devices also require a relatively high control power, and are thus precluded from use in a number of tasks, e.g. where the controlling power is being provided by a computer.

Other kinds of electrical switching circuits are based only upon electronics, i.e. making and breaking is being performed without mechanical contacts. Semiconductor technology is utilized for this purpose. These so-called "SSR-relays" ("Solid State Relay") have great heat losses with high loads, especially with inductive loads. They thus need to be cooled and for this reason they are precluded for a number of tasks. In particular they are precluded for use over a long period of time.

U.S. Pat. No. 4,074,333 (Murakami, at al.) discloses a device in which these detrimental features are eliminated. Said device operates by means of first energizing the load using an electronic coupling means and a bidirectionally controlled, contactless switch, whereupon a mechanical relay connects and holds the load circuit and the contactless switch opens. The order of making and breaking is controlled by a dedicated sequence controller. Means is provided for controlling the triac (contactless switch), responsive to signals from the sequence controller through a phase detector. The phase detector is provided to ensure making and breaking at the point in time where the phase angle in the load circuit equals zero (zero-voltage crossing). A signal is fed back from the triac-controller to the sequence controller, which, through the energizing means, provide closing of the electromagnetic relay.

An advantage of the device disclosed in U.S. Pat. No. 4,074,333 compared to directly using an electromechanical relay, lies in the fact that arcs are avoided in making and breaking the load circuit. The said load circuit is first energized by the contactless switch. This implies utilizing the advantages from both kinds of switches, the "SSR"-technology provides a non-arc making, and the electromagnetic relay provides a permanent connection without substantial heat losses.

A disadvantage with the device disclosed in U.S. Pat. No. 4,074,333 is that it comprises a relatively complex circuit including a plurality of circuit complex circuit elements. If this circuit should be designed according to the description, using existing circuit elements, it would become unreasonably expensive. Furthermore, the device would require a relatively great amount of space, so that the device would have to be large and expensive, and thus of less commercial interest.

SUMMARY OF THE INVENTION

It is a main object of the present invention to provide switching means for making and breaking various kinds of loads to any AC-circuit energy source, especially in cases where any creation of heat or high-frequency noise in making or breaking the load circuit is undesired or unacceptable, or where risks exist for explosion. Importance is attached to providing switching means which is compact, simple, reliable and inexpensive to manufacture. It is a more particular object to improve known switching means, in order to provide switching means being more simple, less expensive, and which requires less space.

The present invention is in some respect based upon similar principle as the device known from said U.S. Pat. No. 4,074,333. However, as opposed to this, the present invention is carried out using a minimum of simple elements, a fact which results in the circuit requiring a minimum of space. Furthermore, the tolerances are not critical for the function of the circuit. All these factors contribute to a very low cost for the manufactured circuit.

DESCRIPTION OF THE DRAWING

In the following a best mode of using the invention will be described with reference to the accompanying drawing, showing a circuit diagram of a switching circuit according to the present invention.

DETAILED DESCRIPTION OF THE INVENTION

Figure 1:
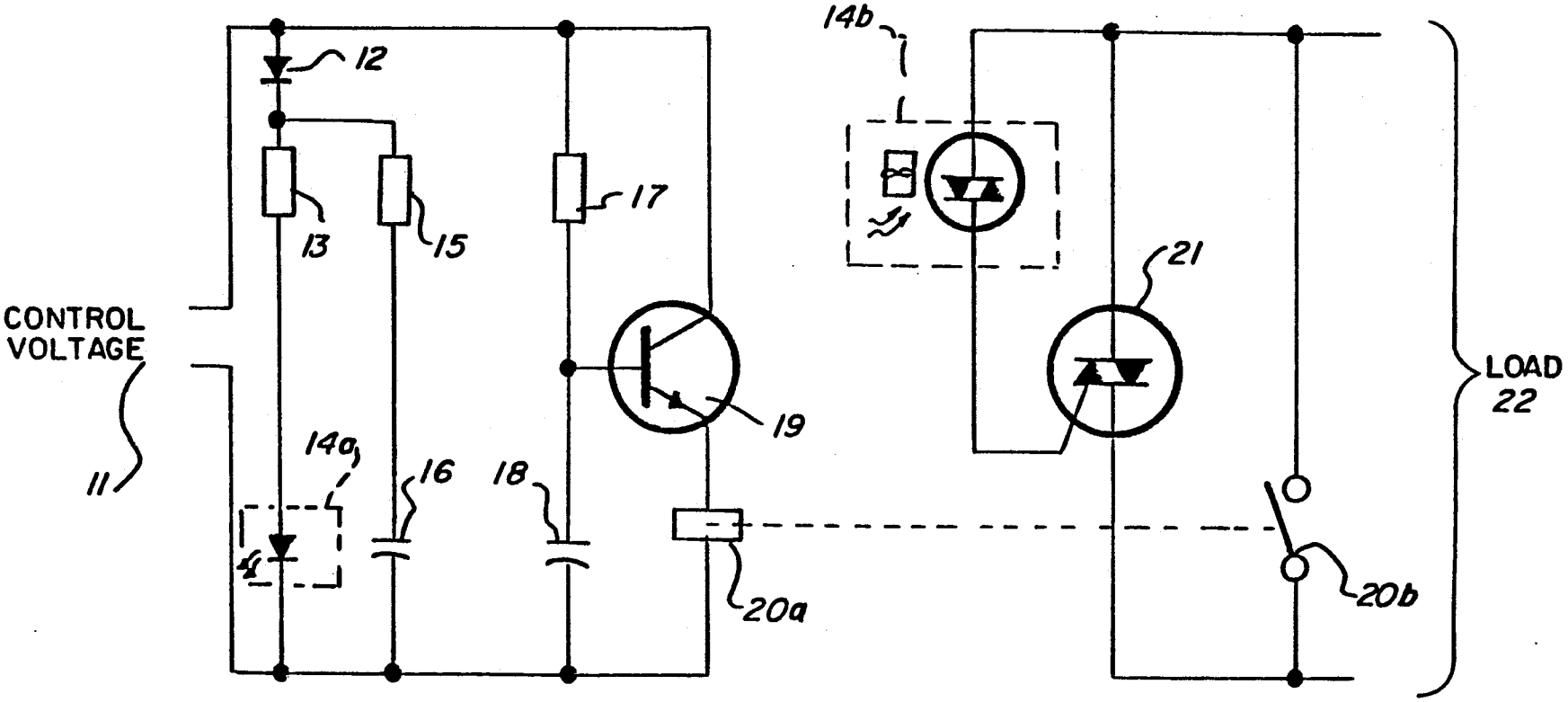

The function of this embodiment is that a control voltage 11 is applied, for controlling making and breaking of the circuit. If AC voltage is to be used, it should be rectified (not shown in the figure). In the presence of the control voltage 11 a current will flow through a diode 12, a resistor 13, and a light-emitting diode section **14*a* of phase detecting optical coupler. This will in turn provide trigging of the light-sensitive section 14*b*. The optical coupler 14*a*, 14*b* is of the kind which is used to control triacs, and in addition delays the making of the load circuit until the phase angle of the load source is at zero voltage. The phase detecting optical coupler 14*a*, 14*b* includes an integrated circuit containing a zero voltage crossing detector. Optically coupler 14*b* is connected to the control input of a triac 21, which is capable of connecting a load 22**. Said load can be inductive, capacitive or pure resistive. Applying voltage to the triac, results in connection of the load.

Simultaneously with the control voltage 11 trigging the triac 20, the same voltage 11 starts generating an electric field in capacitor 18 through a resistor 17. The capacitor 18 will, together with the register 17, form a time-delay circuit (RC-network), which will, in a period of time determined by the selected values of the resistor 17 and capacitor 18, generate a voltage between the base of a transistor 19 and ground, so that the transistor 19 will conduct current through the control coil of a mechanical relay **20*a*, which closes the contacts 20*b* of the relay, making or energizing the load 22. In utilizing a transistor 19 for amplifying the voltage level of the RC-network 17 and 18**, the development of a high charge in the RC-network is rendered redundant, and the capacitor can consequently be of a considerably less capacity.

As the control voltage is trigging triac 21, and starts charging the capacitor 18, the same control voltage also starts charging capacitor 16 through the resistor 15. Resistor 15 and resistor 13, together with capacitor 16 form a time delay circuit. This time delay circuit is utilized in breaking the load connection.

As the control voltage 11 is cut off, the RC-network formed of resistor 15, resistor 13, and capacitor 16, will provide current to optical coupler 14*a*, 14*b* for a period of time determined by said RC-network. On the other hand, the transistor 19 will immediately be turned off, opening the electromagnetic relay 20*a*, 20*b*. However, connection to the load will be maintained by means of the triac 21 until the control voltage entirely disappears when the capacitor 16 is sufficiently discharged. To have the triac 21 break the circuit at the zero-voltage phase crossing, the time constant for the RC-network formed by 13, 15 and 16, should correspond to at least one half of a phase period of the load energy source 22. Still, it could be longer, since the phase detecting optical coupler performs the final load disconnect exactly at the zero-voltage phase crossing. This fact implies that a narrow tolerance of the components are not crucial, and it is possible to use inexpensive components to obtain the same result as with more accurate and expensive components.

By using the optical coupler 14*a*, 14*b* to make and break the triac 21, it provides a complete electrical separation between the control circuit 11 and the load 22.

We claim:

1. A switching circuit for making and breaking an electrical load by means of an electromagnetic relay having electrical contacts for making and breaking said load and a primary coil for actuating said contacts, a bidirectively controlled contactless switch is connected in parallel with said contacts and an optical coupler having a light emitting section and a light sensitive section is connected to control said contactless switch, wherein at making, the bidirectively controlled contactless switch first will connect the load, and after a certain period of time, the electromagnetic relay contacts will be energized to connect the load; and at breaking, the electromagnetic relay contacts will first open, whereupon the bidirectively controlled contactless switch will disconnect the load at a zero voltage phase crossing;

the optical coupler includes a zero voltage phase crossing detector, wherein after activation or deactivation of the light-emitting section, the zero voltage phase crossing detector will detect a zero voltage phase crossing of the load energy source so that the light-sensitive section activates or deactivates the bidirectively controlled contactless switch at a zero voltage phase crossing of the load energy source, and the primary coil of the electromagnetic relay is connected in series with a transistor, said transistor amplifies the voltage level from a first RC-network, comprising a first resistor and a first capacitor, said first RC-network is connected in parallel to the transistor and the primary coil, with the base of the transistor connected between the resistor and the capacitor, to delay the energizing of said primary coil.

2. A switching circuit according to claim 1, wherein a second RC-network is connected to delay the de-energizing of the contactless switch.

3. A switching circuit according to claim 2, wherein said second RC-network has a time constant greater than, or equal to one half of a period of the phase of the load energy source.

* * * * *